United States Patent [19]

McMurtry

[11] Patent Number: 4,685,443

[45] Date of Patent: Aug. 11, 1987

[54] HYDRAULIC FRICTION HEAT GENERATOR

[75] Inventor: Ronald V. McMurtry, Welcome, Minn.

[73] Assignee: Lloyd S. Myster, Fairmont, Minn. ; a part interest

[21] Appl. No.: 4,093

[22] Filed: Jan. 15, 1987

Related U.S. Application Data

[63] Continuation-in-part of Ser. No. 862,468, May 12, 1986, abandoned.

[51] Int. Cl.[4] ..... F24C 9/00

[52] U.S. Cl. ..... 126/247; 122/26

[58] Field of Search ..... 126/247; 122/26; 237/12.1, 50; 165/8, 86; 415/90; 416/DIG. 3

[56] References Cited

U.S. PATENT DOCUMENTS

| | | | |
|---|---|---|---|
| 1,682,102 | 8/1928 | Allen | 126/247 |
| 3,402,702 | 9/1968 | Love . | |
| 4,004,553 | 1/1977 | Stenstrom . | |
| 4,036,562 | 7/1977 | Barnes | 416/DIG. 3 |
| 4,273,075 | 6/1981 | Freihase . | |
| 4,285,329 | 8/1981 | Moline . | |
| 4,366,803 | 1/1983 | Hodge | 126/247 |
| 4,387,701 | 6/1983 | Gibbons . | |
| 4,424,797 | 1/1984 | Perkins | 126/247 |
| 4,481,934 | 1/1984 | Stephenson | 126/247 |

*Primary Examiner*—Randall L. Green

*Attorney, Agent, or Firm*—Robert C. Baker

[57] ABSTRACT

The hydraulic friction heat generator has a cylindrical housing through which passes a motor driven drive shaft along the longitudinal axis. A plurality of discs is mounted on the shaft. Each disc has two or more generally radial slits extending radially inward from the disc periphery. Part of each disc adjacent a slit is angled or feathered outward from the plane of the disc, thereby to form a vane for pumping the hydraulic fluid axially. The discs are spaced from each other to provide free space between adjacent discs in which a high shear zone is created for heat generation by molecular collision in the hydraulic fluid. Heated hydraulic fluid is circulated through a heat exchanger by an impeller.

22 Claims, 9 Drawing Figures

HYDRAULIC FRICTION HEAT GENERATOR

CROSS REFERENCE TO RELATED APPLICATION

This is a continuation-in-part of my application Ser. No. 862,468, filed May 12, 1986, abandoned.

BACKGROUND OF THE INVENTION

This invention relates to a hydraulic friction heat generator of simplified construction having a plurality of discs with radial slits as the actuators for generating heat. The invention also relates to friction furnaces utilizing the generator; and it also broadly relates to a device for converting rotary motion to thermal energy.

So-called "friction furnaces" typically utilize the friction between stationary and rotating discs to generate heat in a hydraulic fluid for transfer in a heat exchanger. Alternate stationary and rotating discs create certain disadvantages. First, the startup torque may be much higher than the running torque and thus a larger than normal drive motor may be needed during startup but be underused during normal operation. Also, rapid wear may occur on the disc surfaces in close relationship, in spite of a film of oil between them. In addition, very high temperatures may be generated in the film between such discs and cause degradation of the oil. Much of the oil tends to bypass portions of the disc surfaces and be heated by admixture with the small quantity of frictionally heated oil. Thus, while a portion of the oil is subjected to degradive high temperatures, the bulk temperature of the oil is much lower, which decreases efficiency. Also, small losses of fluid in the generator for any reason can cause uncontrolled overheating with accompanying damage unless the disc rotation is immediately halted. Further, the moving and stationary discs of prior arrangements are complex in nature and require costly forging and machining in their manufacture.

Continuous screws or augers or the like when used to generate heat in friction furnaces are unable to create the type of turbulence for the hydraulic fluid that is required for improved heat generation from the energy input.

SUMMARY OF THE INVENTION

The present invention provides an apparatus for efficient generation of heat by the self-shearing of the hydraulic heat transfer fluid in the friction heat generator. The generator comprises a cylindrical housing (e.g., a cylindrical drum) and an end plate or means at each end. The housing has an inlet for hydraulic fluid at one end and an outlet at the opposite end. A drive shaft is mounted to pass axially through the fluid-filled generator housing. Mounted on the drive shaft is a plurality of lightweight discs, preferably relatively thin and spaced to leave a free space between adjacent discs in which a high shear zone is created for heat generation.

Each disc has two or more generally radial slits extending part of the distance from the disc annular periphery to the disc axis of rotation. A portion of the disc on one side of each slit is angled or feathered outward from the plane of the disc to form a vane for turbulently forcing (and thus axially pumping) the fluid within the generator housing toward the outlet end.

The annular spacing of the annular-like discs from the annular inner wall of the cylindrical housing or drum is minimal but does allow some flow of fluid in reverse direction to that pumped by the vanes of the discs. The forward flow of fluid caused by the slit discs collides somewhat with the reverse fluid flow in the annular space to create a zone of high internal shear intermediate the adjacent discs. Shearing stresses of fluid forced downstream by the discs also arise, with the hydraulic fluid subjected to turbulence created by the discs while at the same time being pushed forward or downstream. Intermolecular shearing stresses arise under the high turbulence conditions created; and thus heat is generated.

The heated fluid is preferably circulated from the generator to a heat exchanger for heating any suitable fluid medium (e.g., air, oil, water or other fluid) passed over the exchanger.

In the preferred form, the outermost annular portion of each disc of the generator is dished at an angle from the plane of the disc to form a convex and concave side on the disc. Preferably, the concave side faces the downstream or outlet end of the generator.

BRIEF DESCRIPTION OF THE DRAWINGS

The present invention will be better understood from the following description taken in conjunction with the accompanying drawings, wherein:

FIG. 1 is a front elevational view of a hydraulic friction furnace with parts broken away to expose a motor driven heat generator embodying the present invention in combination with a heat exchanger, motor/blower unit, and air ducts to form a system for heating buildings and the like;

DESCRIPTION OF THE PREFERRED EMBODIMENTS

Figure 1:
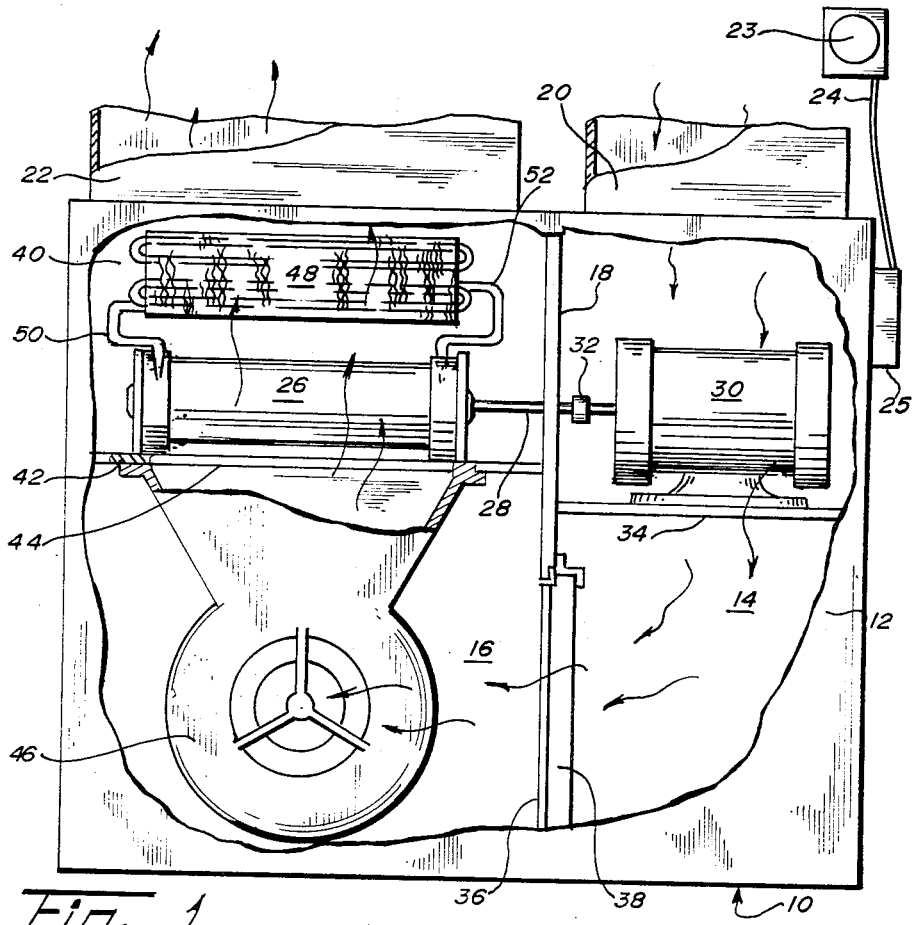

FIG. 1 illustratively shows a warm air furnace 10 having features according to the present invention. Furnace 10 has a hollow, sheet metal housing 12 which is separated into two main compartments 14 and 16 by a vertical partition 18 located near the center of the housing. At the top of the housing, there is a return air duct 20 that empties into the first main compartment 14, and a warm air duct 22 that carries warm air from second main compartment 16 for heating a building or other apparatus or area requiring heat. A horizontal shelf 42 creates a warm air plenum 40 in the upper portion of the second main compartment 16.

Four main elements are included within housing 12. First, a friction heat generator 26 has a shaft member 28 which extends externally thereof through a suitable hole in partition 18 for coupling with an electric motor 30 by means of the coupler 32. This motor is supported on motor supports 34 and controlled by thermostat 23 via signal wire 24 to motor control unit 25. The lower portion bf the vertical partition 18 is provided with a large opening 36 which is fitted with a furnace filter 38 for cleaning the air of dust and other objectionable matter before the air passes through the second main compartment 16 to be pressurized and heated.

The friction heat generator 26 is supported on horizontal shelf 42. A large opening 44 is formed in the shelf 42 beneath the friction heat generator 26, and a motor/-blower unit 46 is suspended from the shelf 42 beneath opening 44 for drawing in the return air that passes through the filter 38 into the compartment 16, and forces it upward past friction heat generator 26. Above the friction heat generator is mounted a heat exchanger 48 which is connected in series with the friction heat generator 26 by means of conduits 50 and 52. Air pressurized by motor/blower unit 46 to flow upward past generator 26 passes over heat exchanger 48 to be heated thereby.

Heat exchanger 48 may consist of any means which will provide sufficient heat exchange surface for promoting heat transfer from the hot hydraulic heat transfer fluid to the material being heated. Usually, the heat is to be transferred to an air stream. Typically, heat exchangers with finned tubes are used for efficient transfer of heat from the heated hydraulic fluid to air passing over and between the fins and tubes.

Figure 2:
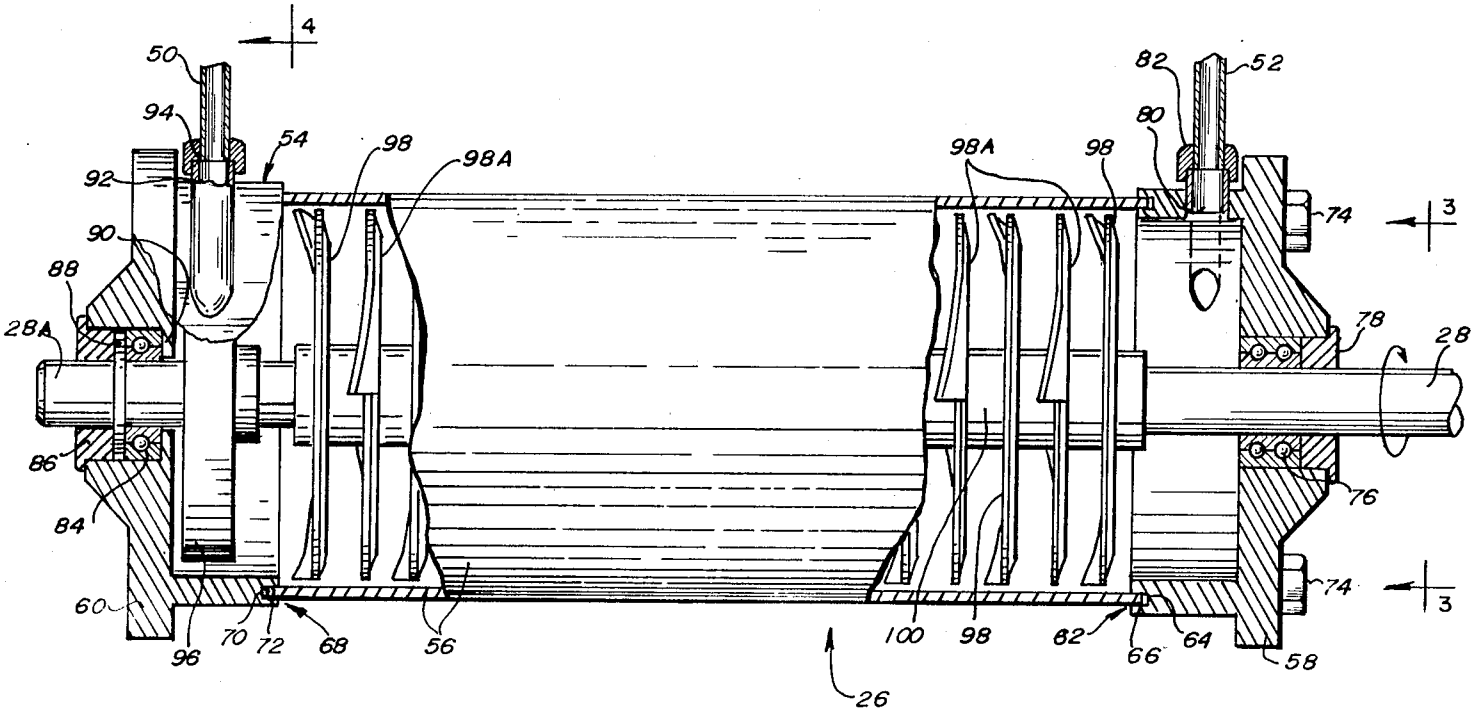
FIG. 2 is a longitudinal, cross-sectional elevational view of the friction heat generator embodying the present invention.

FIG. 2 is an enlarged view of the friction heat generator 26 and shows it in a longitudinal, partial cross-sectional, elevational view. This friction heat generator 26 comprises a cylindrical drum 56 which is closed at each end by opposite end plates 58 and 60, respectively. First or upstream end plate 58 is provided with a circular groove 62 which receives circular gasket 64 and the adjacent end 66 of the cylindrical drum 56. Likewise, second or downstream end plate 60 is provided with a circular groove 68 for receiving circular gasket 70 and the adjacent end 72 of cylindrical drum 56.

First end plate 58 has a centrally located hole therethrough for receiving and mounting drive shaft 28 in bearing 76 and seal 78. Seal 78 is accessible from the exterior for removal and mounting. Inlet conduit 52 is connected to coupling assembly 82 which is mounted in inlet port 80 in first end plate 58, for introducing a heat transfer fluid into the heat generator 26. The inlet is preferably tangential in its entry into the upstream end of the cylindrical housing of the generator.

Second end plate 60 has a centrally located hole therethrough for receiving and mounting the opposite end of drive shaft 28 in bearing 84 and seal 86. In the embodiment shown in FIG. 2, second end plate 60 includes a shoulder 90 to support bearing 84 against inward movement. A flange 88 on drive shaft 28 retains the shaft in position. In this example, bearing 84 may be a thrust bearing. Other bearing and seal apparatus may be used to mount shaft 28 in the end plates, provided the shaft is allowed to rotate with minimum friction and without significant axial movement, and provided heat transfer fluid does not leak from the mountings. A thrust bearing, if used, may be placed within either or both the end plates. The seals may be of the packing variety, or mechanical seals. Both types are well-known in the art.

Figure 4:
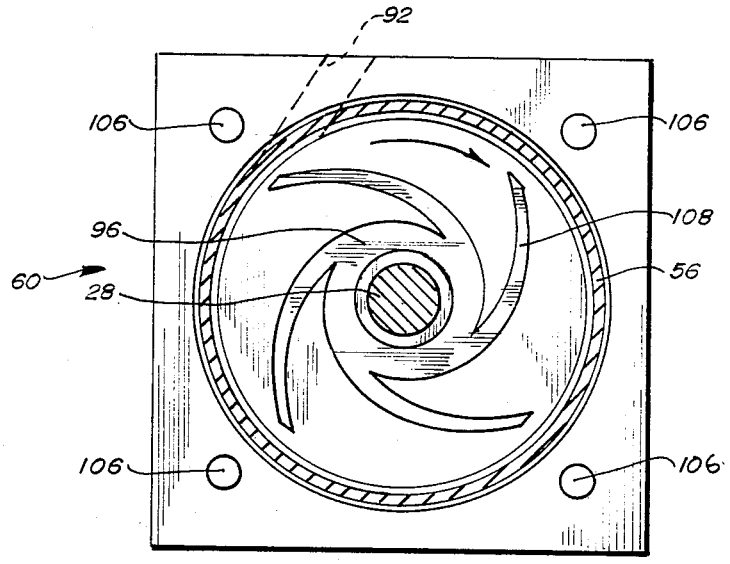
FIG. 4 is a transverse, cross-sectional view through the cylindrical housing of the friction heat generator taken on line 4—4 of FIG.2, showing the interior of the second or downstream end plate with the pump rotor or impeller at the end.

Second end plate 60 has an outlet port 92 on its circumferential surface 54. Outlet conduit 50 is connected to coupling assembly 94 which is mounted in outlet port 92. Heat transfer fluid is pumped from the friction heat generator 26 through port 92, coupling assembly 94, and conduit 50 to heat exchanger 48. Again it is emphasized, as shown schematically in FIG.4, that tangential orientation of this port with respect to the cylindrical housing is employed.

Within cylindrical drum 56 on the drive shaft 28 are a plurality of generally smooth surfaced discs 98, 98A, normal to the shaft axis. The outer annular portion of each disc 98, and 98A is dished, and the discs are mounted so that the concave side faces downstream within friction heat generator 26. The discs are spaced from each other in a generally uniform manner. The peripheral edges of the discs are closely spaced from the inner wall of the cylindrical drum 56. In the embodiment shown in FIG. 2, the discs are shown as being mounted on shaft 100 which is attached coaxially to shaft 28. Shaft 100 may be a hollow shaft through which shaft 28 passes, and these shafts may be attached or fixed to each other by a key and in keyways in both shafts. Alternatively, shaft 100 may be an enlargement of shaft 28. Optionally the plural discs may be attached directly to shaft 28 itself without any enlargement. In the embodiment illustrated, the apparatus may be disassembled and the drive shaft 28 removed from the heat generator 26 without removing the discs from the shaft 100. Thus, the precise alignment of the discs will remain unchanged, saving time during re-assembly. The discs may be welded to shaft 100 or attached in alternative ways. Press fitting of the discs to the shaft is suitable; and the use of snap rings or compression nuts may alternatively be used.

The pumping means used for circulating hydraulic heat transfer fluid through the heat generator 26 and heat exchanger 48 is preferably of the impeller type. In FIG. 2, pump 96 is shown mounted on drive shaft 28 to rotate therewith. The impeller 96 is mounted adjacent second end plate 60 to pump heated heat transfer fluid from the friction heat generator 26 through tangential outlet conduit 50 to heat exchanger 48. The preferred impeller rotor 96 has swept-back vanes common to low-head liquid pumps; and the impetus these give to the hydraulic fluid serves to 37 throw" the fluid out the tangentially oriented outlet.

The end plates 58 and 60, together with cylindrical drum 56, may be held together by any means. For example (see FIG. 2), threaded tie rods 74 with nuts at one end may be passed through end plate 58 and screwed into threaded holes in end plate 60. The nuts are turned to pull the end plates together until they seal with the drum 56. Alternatively, other methods of forming the cylindrical housing may be utilized.

Alternatively, the second end 28A of drive shaft 28 may be mounted in a central recess in second end plate 60. In this embodiment, drive shaft 28 does not extend through second end plate 60, and seal 86 is not used. The end 28A is supported in a rotary bearing 84 seated in the recess which faces rotor impeller 96.

Figure 3:
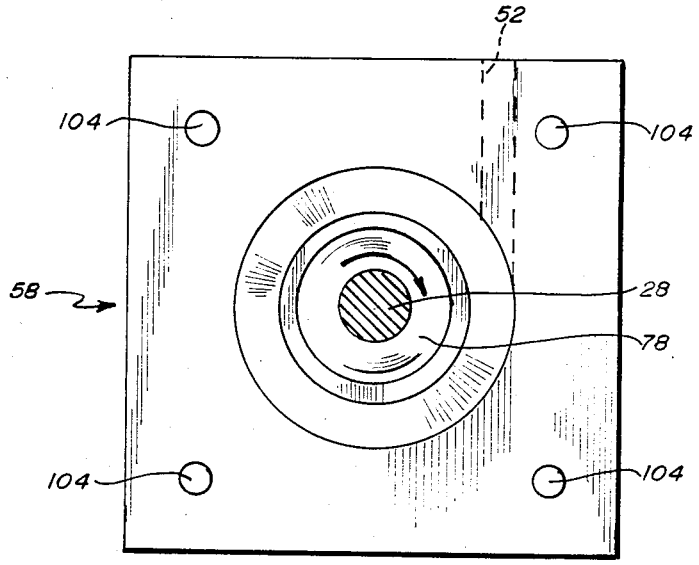
FIG. 3 is a transverse end view of the first or upstream end plate, as taken along line 3—3 of FIG. 2.

Now turning to the end view of FIG.3, which is taken along line 3—3 of FIG. 2, the first end plate 58 is shown illustratively as a square plate with tie rod holes 104 in each corner. FIG. 3 shows shaft 28 and the exterior surface of rotary seal 78 as well.

Like first end plate 58, second end plate 60 (FIG. 4) is shown as a square plate. Threaded holes 106 in each corner receive tie rods for holding the end plates tightly against cylindrical drum 56. As already described, the tie rods pass through holes 104 and are screwed into threaded holes 106 to form the sealed cylindrical housing. Pump 96, having a plurality of curved vanes 108 is shown mounted on shaft 28, and is rotated thereby in the direction indicated.

Figure 5:
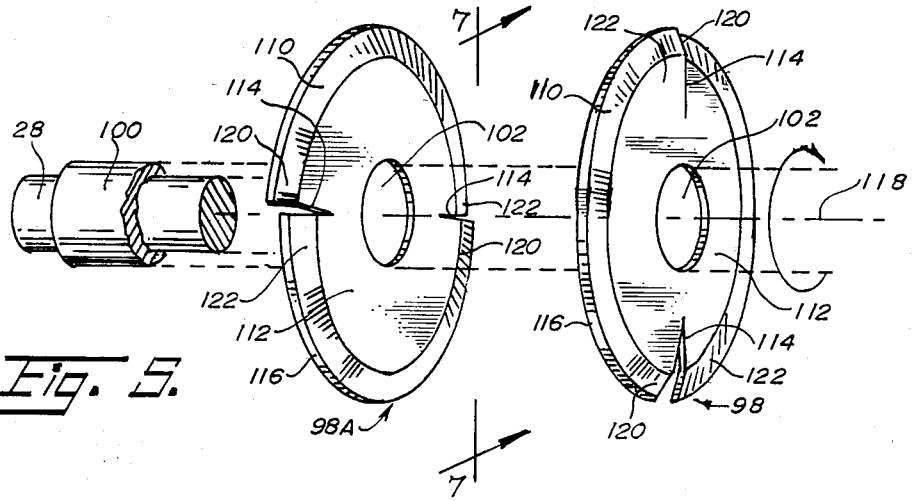
FIG. 5 is an exploded perspective view of two adjacent discs of the generator of this invention.

Next to be discussed is the design, spacing and orientation of discs 98, 98A within friction heat generator 26. The perspective view of the discs in FIG. 5 shows the discs to be thin circular plates with generally smooth surfaces. The discs may be advantageously made from flat metal sheet or plate. Each disc 98, 98A has a central hole 102 through which shaft 100 axially passes. All discs along shaft 100 are identical, except for their orientation on shaft 100.

An outer annular portion 110 of the discs is dished at an angle from the plane of the flat disc face 112, and the discs are mounted on the shaft so that the concave side of each disc faces downstream, i.e., generally toward the outlet port 92, and the convex side faces upstream (or toward inlet 52). Centrifugal forces act on the hydraulic fluid on the upstream side (or back side) of the dished periphery, serving to generate a toroidal zone of reduced pressure, which in combination with other disc features causes turbulence and the desired heat generation. The dished configuration may easily be formed by a pressing process.

Each disc 98, 98A, etc., is shown with two radial slits 114 which partially transect the disc face 112. The slits extend inward generally radially from the annular disc periphery 116. The slits are preferably on opposite sides of the disc in opposing relationship and preferably extend inwardly only part of the distance toward the axis of rotation 118. Although the discs are fixed on shaft 100, excessive extension of slits 114 toward center hole 102 may necessitate thicker disc walls to prevent distortion during operation. Thus, a portion of the disc radius is preferably unslitted, providing additional strength to the thin discs.

Figure 8:
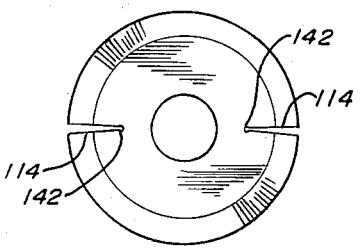
FIG. 8 is a face view of a disc of the invention equipped with a circular slight enlargement of the inner terminus of the slit to inhibit fatigue extension of the slit inwardly.

A preferred way to inhibit fatigue extension of the disc slits 114 inwardly toward the center is to form a smooth substantially transverse cut at the inner end of the slit, suitably by punching a small hole 142 (see FIG. 8) at the inner terminus of the slit. This creates a slight circular enlargement at the inner end of the slit and inhibits inward extension of the slit as may arise from operating fatigue.

One should note that at least one side of each slit on discs 98, 98A, etc. is feathered outward from the plane of the disc to form a vane for turbulently forcing or pumping hydraulic fluid axially toward the outlet end of the generator. Each side of a slit may be feathered outward to create a spacing therebetween in the axial direction, but at least one side is feathered outward in either the upstream or the downstream direction. For example, the portion 120 of disc 98, 98A, etc., which is adjacent each slit 114 at the leading side during rotation, is suitably angled or feathered in the downstream direction (i.e., toward downstream) to form a vane 120. Each vane 120 includes a section or part of the outer annular portion 110 adjacent slit 114.

Figure 9:
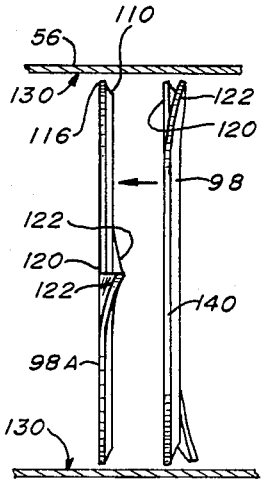
FIG. 9 is a schematic side elevation of two adjacent discs illustrating feathering of the vane portion at the trailing side of the slits toward the upstream direction, as is most preferred.

In an alternate and most-preferred arrangement (see FIG. 9), the disc portion on the trailing side 122 of slit 114 is angled or feathered in the upstream direction (i.e., toward the inlet end); and the leading side is not feathered from the disc plane. This most preferred arrangement creates less drag or draw on the motor as compared to feathering the leading side downstream.

It is emphasized that, as the terms are used herein, the leading side of a slit is the trailing side or edge of the total vane (which extends between slits) during rotation.

As shown in FIG.5, each disk is identical on shaft 100, except for the orientation of the slits thereof. Preferably, the discs are attached to shaft 100 so that the slit of adjacent discs are not aligned along the shaft. In other words, the radial slits should be offset from on disc to the next along shaft 100. Preferably each alternate disc 98 has its slits aligned and the slits of discs 98A between each are also aligned but at 90° relative to the alternating discs 98A. This arrangement is pictured in FIG. 2.

Figure 6:
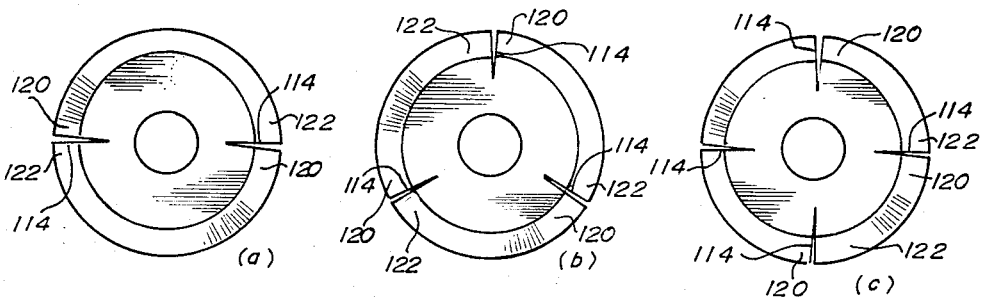
FIG. 6 is a face view of three embodiments of the disc of the present invention.

Although discs having two slits and two vanes are preferred, discs with additional slits and vanes may be used. In FIG. 6, discs with 2, 3, and 4 slits are shown as embodiments (a), (b), and (c), respectively. When using discs with three slits 114 and three vanes 120 as in embodiment (b), the adjacent discs are preferably radially displaced by approximately 60°. For discs with four slits and four vanes, the preferred displacement is about 45°. In general, the angular displacement of adjacent discs from each other is 180/N, where N is the number of slits per disc. Thus, the slit positions on each disc are radially equi-spaced and are intermediate those of the adjacent discs.

Of course, where the direction of rotation is reversed from that clockwise direction shown, the trailing portion of vane 120 will be on the opposite side of the slit to that aforediscussed.

When the discs are rotated by motor 30, the trailing side of the slit slices off a portion of the heat transfer fluid and forces it turbulently downstream with a multitude of frictional molecular shearing actions which generate heat. Further, zones or nodes of reduced pressure are created by the disc slits. Heat transfer fluid rushes downstream in response to the reduced pressure zones or nodes.

Figure 7:
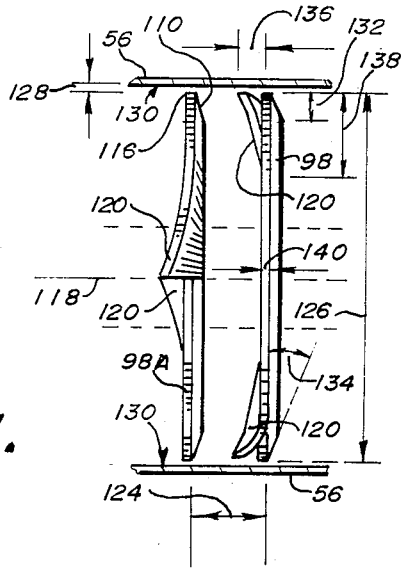
FIG. 7 is a side elevational view of two adjacent discs together with a portion of the cylindrical housing in cross-section, showing disc spacing, orientation, and design, the view being taken along line 7—7 of FIG. 5.

FIG. 7 is a side view of two adjacent discs 98 and 98A as taken along line 7—7 of FIG. 5. The drawing illustrates the disc features as described herein and includes a partial cross-sectional view of cylindrical drum 56 to show the clearance 128 between disc periphery 116 and the inner wall surface 130 of drum 56. Discs 98 and 98A are oriented on shaft 100 at an interdisc spacing 124 which may vary from about 0.05 to 0.25 of disc diameter 126. The spacing 124 is preferably between 0.1 and 0.16 of disc diameter 126. Thus, the preferred spacing 124 for discs of 8 inches diameter and 1/16 inch thickness is about 0.8 to 1.28 inches.

The dished outer annular portion 110 may extend inwardly up to about one half of the disc radius, but preferably is less than about one fifth thereof. Thus, for an 8 inch diameter disc 98, the dished annular portion preferably extends radially inwardly from the disc periphery 116 toward the disc axis 118 for an annular width 132 of up to 1.6 inches.

The dish angle 134 may vary up to 45°. Generally, angle 134 varies with the width 132 of the annular dished portion, so that as the annular width 132 is increased, angle 134 is decreased to achieve the same general pumping effect. Generally, angle 134 is between 3 and 20 degrees.

The vane feathering or extension distance 136 is in the axial direction and is somewhat exaggerated in FIGS. 2, 5, 7, and 9 for the sake of clarity. Extension distance 136 from the plane of the disc is dependent upon disc diameter 126, slit length 138, the wall thickness 140 of the disc 98, 98A, disc rotational speed, and clearance 128 between disc periphery 116 and inner wall surface 130 of cylindrical drum 56. The maximum vane extension distance 136 is generally about 3 up to about 8 times the disc wall thickness 140. While FIG. 7 illustrates the vane extension distance in terms of feathering in the downstream direction, the same principles as here discussed also apply for the preferred feathering in the upstream direction.

The wall thickness of the discs is generally no greater than that required to provide the necessary strength to avoid disc distortion at the high speeds. The discs generally have a diameter to thickness ratio of about 50:1 to 200:1. Thus, an 8 inch diameter disc may be formed from 1/16 inch metal plate. The dished annular portion 110 also strengthens the discs against distortion. The weight reduction resulting from the use of thin discs means a considerable reduction in starting inertia to decrease the starting torque required of motor 30.

The system of heat generator, heat exchanger 48, and connecting fluid conduits 50 and 52 is filled with a heat transfer fluid such as hydraulic fluid or fluids formulated specifically for heat transfer applications. Unlike recommendations for other systems, it is not necessary to completely purge or bleed air from the system. The system works well with some air in the system, although excessive quantities result in reduced heat production and should also be avoided so as to reduce or obviate the possibility of air lock or blockage problems. But some air in the system is in fact desirable. Unlike other friction heat generators, complete or nearly complete fluid loss will not damage the generator. Such loss will merely cause a loss in heat generation. Of course, the system may include an expansion chamber and/or a pressure relief valve to meet standard governmental safety regulations.

To operate the generator, motor 30 is turned on by a thermostat 23 (or by a manual switch) for example, and it rotates shaft 28 to turn the plurality of discs 98, 98A at high speed. Alternate discs in the entire disc assembly are angularly displaced by 90°, 60°, or 45°, depending on the number of vanes and slits in each disc. Two separate types of pumping action are created by the rotating discs. First, the dished portion 110 creates a downstream directed force in that vicinity of the generator (i.e.) near the annular space between disc periphery 116 and inner wall surface 130. This pumping force more or less causes the fluid to encircle each disc, and is less than the second pumping force. The second type of pumping force is created by vanes 120 on each disc. Although pump impeller 96 circulates heated fluid through heat exchanger 48 to create a general fluid movement from one end of the generator 26 to the other end thereof, the resultant quantity of fluid circulating about each disc far exceeds the overall fluid circulation moving through generator 26 and heat exchanger 48. For example, a theoretical pumping rate of about 46 gallons per minute (gpm) may be calculated for a disc having the following specifications:

disc diameter: 8 inches
disc rotation speed: 1750 rpm
number of vanes per disc: 2
slit length: 2 inches
maximum vane extension distance: 5/16 inch In such a system, the overall circulation rate through the generator and heat exchanger is estimated to be about 1–10 gpm. Heat transfer fluid with an approximate density of 7 pounds per gallon and a specific heat of about 0.6 BTU/pound-°F. should give up about 504 BTU/gallon when cooled from 240° to 120° F. Thus, a circulation rate of 3 gpm through the heat exchanger 48 under these conditions will transfer about 90,720 BTU per hour.

Circulation of heat transfer fluid about each disc also causes a rather high return rate of fluid in the annular space surrounding each disc. Spacing 128 is such that the velocity of this reverse flow past the disc periphery 116 is usually at least about 3 feet/second, and possibly even at least about 5 feet per second, creating a high turbulence internal liquid shear zone in that vicinity and between adjacent discs.

The discs, having generally smooth surfaces and not being in frictional contact with each other, create little drag on motor 30. The heat is produced not by passage of a thin film of fluid between two solid surfaces which are in forced frictional contact. Instead heating results from the collision of a mulititude of high velocity fluid streams in a toroidal high shear zone of turbulence intermediate adjacent discs. This turbulent collision is intermolecular in nature and is termed internal because the friction of colliding liquid molecules, not solid-liquid or solid-solid friction, generates the heat. High velocity eddies of fluid are produced in the high shear zone, and lower velocity eddies generally occur toward the smooth disc surfaces.

If one considers the entire fluid between two adjacent rotating discs, each having two vanes, the toroid of high shear will have four nodes of highest shear, corresponding to the two vanes on the upstream disc and the two intermediately located vanes on the downstream disc. These nodes, or zones of highest shear, will rotate about shaft 28 at a speed corresponding to the disc rpm, even though the bulk fluid rotational velocity will be lower. The internal liquid shear will generally be lower at the flat disc wall surfaces.

The optimal rotational speed of the discs is a function of disc diameter 126, pumping capacity of each disc per revolution, and the net backflow or reverse flow of fluid in the annular space between the disc periphery 116 and the inner wall surface 130. For a heat generator with 8-inch diameter discs operating at 1750 rpm, and a heat exchanger with a total (roughly-calculated) heat transfer surface area of approximately 150 square feet, a steady state oil temperature of about 240° F. was attained in about 10 minutes, starting with oil at room temperature. Increasing the speed to 3500 rpm and to 5250 rpm decreased the heating-up period to about 5 to 7 ½ minutes. It appears that system efficiency decreases at disc speeds greater than about 5000 rpm. At speeds below about 750 rpm, heat generation is considerably reduced. In general, for 8-inch discs, the preferred disc speed is in the range of 1200–2400 rpm.

For most installations, a single speed motor will be used to turn the discs. Variable speed motors may be used, however, when it is desirable to fine-tune the heat generation capacity.

It is anticipated that, in most installations for heating of air in buildings, the temperature of the heat transfer fluid will not generally drop all the way to room temperature during thermostat-controlled OFF cycles, but may drop to 100°–150° F., for example, before the heater returns to the ON cycle. Thus, recovery time, i.e. the time to attain a steady state temperature of 240° F., will be shortened from that during start up. Of course, heat will be delivered to the building air as long as the oil temperature exceeds the air temperature and air is circulated over the heat exchanger.

While 240° F. is shown herein as an exemplary steady-state fluid temperature, any temperature resulting in efficient heat exchange without degrading the heat transfer fluid may be used.

The use of larger diameter discs having a greater pumping capacity per revolution somewhat reduces the optimum disc rpm. Smaller discs generally must be operated at a higher speed to achieve the optimal efficiency.

The number of discs 98, 98A in a heat generator 26 depends upon the heating requirements and may vary from several to as many as may be practically installed on a shaft and rotated. A typical furnace for heating a residence may have from about 8 to about 30 discs, for example, in the heat generator 26.

This invention as elucidated in the foregoing description has a number of advantages over the prior art.

The discs have a generally smooth surface and are light in weight. Both factors contribute to a low starting and running torque load on the motor. These discs result in low drag on the motor.

Since there are no solid surfaces moving against one another under pressure, as in other friction generators, erosion of such wearing surfaces is eliminated. Maintenance requirements are thus much reduced.

Furthermore, elimination of devices for exerting pressure on the frictional members greatly simplifies construction, maintenance and operation of the friction heat generator of this invention.

The discs of this invention may be easily and inexpensively constructed from metal plate or sheet.

A partial or total loss of fluid from the generator housing during operation does not result in self-destruction of the discs as occurs in other friction generators. The fluid loss merely results in a reduction or cessation of heat production. Furthermore, complete purging of air from the system before operating is not required; some air in the system is in fact desirable as a buffer for hydraulic expansion.

The friction heat generator of the invention may be employed as a pump to heat and move liquids; it may be used to heat water; and it may be used with heat exchangers for a wide variety of liquid or gaseous heating applications.

Modifications of this invention will occur to those skilled in the art. Therefore, it is to be understood that this invention is not limited to the particular embodiments disclosed, but that it is intended to include all modifications which are within the spirit and scope and equivalents of the appended claims.

That which is claimed is:

1. A hydraulic friction heat generator filled' with hydraulic heat transfer fluid, comprising:

a cylindrical housing with a central axis through its interior and with end plates generally normal to said central axis, said generator having an inlet conduit means and an outlet conduit means located at opposite ends of the cylindrical housing thereof;

a drive shaft bearingly mounted in each of said end plates in coaxial alignment with said central axis and passing through one of said end plates to extend outwardly therefrom;

an external power source joined to said extended shaft for rotating said shaft; and a plurality of smooth-surfaced thin discs with outer generally annular peripheral edges closely-spaced from the inner wall of said cylindrical housing, said discs being fixedly mounted in axially spaced relationship on said drive shaft to be rotated thereby in a single direction, with no stationary elements interposed between said discs, each said disc having at least two radially-oriented slits partially transecting said disc to extend inward from said disc peripheral edges, and said discs having a portion of each said disc on one side of said slit feathered outward from the plane of said disc to form a vane for turbulently forcing said hydraulic fluid axially toward said outlet conduit means.

2. The generator according to claim 1, wherein:

an outermost annular portion of each said disc is dished at an angle not to exceed 45° from the plane of said disc to form a rearward convex and forward concave side on said disc, said dished outermost annular portion being of less radial extent than said disc slits.

3. The generator according to claim 2, wherein:

said heat transfer fluid is discharged from said outlet conduit means at one end of said cylindrical housing, and said concave side of each said disc faces said end having said outlet conduit means.

4. The generator according to claim 1, additionally including:

a heat consuming apparatus;

said outlet conduit means being connected to said heat consuming apparatus;

said inlet conduit means being also connected to said heat consuming apparatus; and pumping means for circulating heat transfer fluid through said outlet and inlet conduit means and said heat consuming apparatus and said friction heat generator in a circuit.

5. The generator according to claim 4, wherein:

said heat consuming apparatus comprises a heat exchanger.

6. The generator according to claim 4, wherein:

said pumping means comprises an impeller mounted on said drive shaft to be rotated thereby so as to pump heat transfer fluid out said outlet conduit means.

7. The generator according to claim 1, wherein:

each of said discs has at least three and no more than four said slits.

8. The generator according to claim 1, wherein:

all of said discs are fixedly mounted on a hollow cylindrical shaft through which said drive shaft passes, said hollow cylindrical shaft being fixedly attached to said drive shaft to rotate therewith.

9. The generator according to claim 1, wherein:

said external power source comprises means to provide a rotational speed of 1200 to 2400 rpm.

10. The generator according to claim 1, wherein:

the ratio of disc diameter to disc wall thickness is between 50:1 and 200:1.

11. The generator according to claim 1, wherein:
said slits on each said disc are radially displaced from slits of neighboring discs by approximately 180/N degrees, where N is the number of slits in each said disc.

12. The generator according to claim 1, wherein:
said slits in said discs extend inward radially a distance from said disc periphery no greater than about one-half the radius of the disc.

13. The generator according to claim 1, wherein:
the spacing between adjacent discs is between 0.05 and 0.25 of the diameter of said discs, all said discs having the same diameter.

14. The generator according to claim 1, wherein:
each slit of each said disc has a leading side and a trailing side during the rotation of said drive shaft, said one side of each said disc feathered outward from the plane of said disc being said leading side, and said leading side being feathered toward said end of said heat generator having said outlet conduit means.

15. The generator according to claim 2, wherein:
said angle from the plane of said disc does not exceed 20 degrees.

16. The generator according to claim 2, wherein:
each slit of each said disc has a leading side and a trailing side during the rotation of said drive shaft, said one side of each said disc feathered outward from the plane of said disc being said leading side, and said leading side being feathered toward said end of said heat generator having said outlet conduit means.

17. The generator according to claim 4, wherein:
said pumping means comprises an impeller rotor fixedly mounted on said drive shaft at the end of said cylindrical housing having said outlet conduit means; and
said outlet conduit means is tangentially oriented to said cylindrical housing to extend tangentially therefrom in the same direction as the rotary direction of pumping of heat transfer fluid effected by rotation of said impeller rotor.

18. The generator according to claim 4, wherein:
said pumping means comprises an impeller rotor fixedly mounted on said drive shaft at the end of said cylindrical housing having said outlet conduit means;
said outlet conduit means is tangentially oriented to said cylindrical housing to extend tangentially therefrom in the same direction as the rotary direction of pumping of heat transfer fluid effected by rotation of said impeller rotor; and
said inlet conduit means is tangentially oriented to said cylindrical housing to extend tangentially therefrom in a direction opposite that of the direction of rotation of said impeller rotor.

19. The generator according to claim 1, wherein:
each slit of each said disc has a leading side and a trailing side during the rotation of said drive shaft, said one side of each said disc feathered outward from the plane of said disc being said trailing side, and said trailing side being feathered toward said end of said heat generator having said inlet conduit means.

20. The generator according to claim 2, wherein:
each slit of each said disc has a leading side and a trailing side during the rotation of said drive shaft, said one side of each said disc feathered outward from the plane of said disc being said trailing side, and said trailing side being feathered toward said end of said heat generator having said inlet conduit means.

21. The generator of claim 1 wherein the radially inward end of each said slit terminates at a circular enlargement which inhibits fatigue inward extension of the slit.

22. A hydraulic friction furnace for heating air comprising:
a hollow, sheet-metal furnace housing separated into first and second compartments by a partition;
a return air duct emptying into said first compartment;
an opening in said partition for passing air from said first compartment to said second compartment;
a heat exchanger in said second compartment having tubes for carrying a heated hydraulic fluid and a surface area for transferring heat therefrom to said air;
a warm air duct for discharging warm air from said furnace;
fan means for blowing return air past said heat exchanger;
a friction heat generator supported within said second compartment and including a drive shaft driven by an external motor, said heat generator having a hydraulic-fluid-filled housing comprising a cylindrical drum and end plates at each end for bearingly mounting said drive shaft, said drive shaft having mounted thereon a spaced plurality of smooth-surfaced discs with generally annular peripheral edges, said edges being spaced from the inner wall of said cylindrical drum and having at least two radially inward slits per disc partially transecting each said disc, said slits being equally spaced from each other on each disc, with a portion of each said disc on one side of each said slit being feathered outward from the plane of said disc to form a vane for pumping said fluid axially;
conduit means for passing hydraulic fluid from said friction heat generator to and from said heat exchanger in a circuit;
pumping means for pumping fluid in said circuit,
whereby rotation of said discs mounted on said drive shaft produces toroidal high shear zones in said hydraulic fluid intermediate adjacent discs and spaced therefrom, to thereby generate heat in said hydraulic fluid by internal intermolecular friction in said hydraulic fluid in said high shear zones.

* * * * *